US008733219B2

(12) United States Patent
Benard et al.

(10) Patent No.: US 8,733,219 B2
(45) Date of Patent: May 27, 2014

(54) CUTTER DEVICE FOR CUTTING MAILPIECES OPEN

(75) Inventors: Serge Benard, Bois Colombes (FR); Dominique Bernard, Massy (FR)

(73) Assignee: Neopost Technologies, Bagneux (FR)

( * ) Notice: Subject to any disclaimer, the term of this patent is extended or adjusted under 35 U.S.C. 154(b) by 132 days.

(21) Appl. No.: 13/326,682

(22) Filed: Dec. 15, 2011

(65) Prior Publication Data

US 2012/0152078 A1 Jun. 21, 2012

(30) Foreign Application Priority Data

Dec. 16, 2010 (EP) ..... 10306426

(51) Int. Cl.
*B26D 7/06* (2006.01)

(52) U.S. Cl.
USPC ..... 83/434; 83/446; 83/496

(58) Field of Classification Search
USPC ..... 83/912, 434, 436.9, 497, 496, 446, 444; 414/412, 416.03
See application file for complete search history.

(56) References Cited

U.S. PATENT DOCUMENTS

| | | | | | |
|---|---|---|---|---|---|
| 668,945 | A | * | 2/1901 | Allen | 83/499 |
| 1,408,415 | A | | 2/1922 | Smith | |
| 2,027,045 | A | * | 1/1936 | Keiser | 83/418 |
| 3,204,503 | A | * | 9/1965 | Simjian | 83/176 |
| 3,381,564 | A | | 5/1968 | Whiteford | |
| 3,682,032 | A | * | 8/1972 | Pfeiffer | 83/496 |
| 4,092,886 | A | * | 6/1978 | Nowisch | 83/56 |
| 4,210,045 | A | * | 7/1980 | Osburg | 83/497 |
| 4,318,322 | A | | 3/1982 | Russell | |
| 4,419,915 | A | * | 12/1983 | Oussani | 83/887 |
| 5,156,515 | A | | 10/1992 | Charron et al. | |
| 5,188,012 | A | * | 2/1993 | Emich | 83/496 |
| 5,946,996 | A | * | 9/1999 | Oussani et al. | 83/444 |
| 7,231,859 | B2 | * | 6/2007 | Lawrence | 83/508.1 |

OTHER PUBLICATIONS

European Search Report cited in EP 10 30 6426, dated Mar. 11, 2011.

* cited by examiner

*Primary Examiner* — Omar Flores Sanchez
(74) *Attorney, Agent, or Firm* — Sughrue Mion, PLLC

(57) ABSTRACT

A cutter device for cutting envelopes open, which cutter device includes a rotary cutter suitable for cutting open an envelope, and a rotary bearing element against which said envelope is in contact as it goes past the rotary cutter, an axis of rotation of the bearing element forming a predetermined angle of inclination with a drive axis of the rotary cutter.

9 Claims, 3 Drawing Sheets

CUTTER DEVICE FOR CUTTING MAILPIECES OPEN

TECHNICAL FIELD

The invention relates to the field of mail-handling and it relates more particularly to a machine for opening envelopes (or "letter opener") including an improved cutter device.

PRIOR ART

U.S. Pat. No. 5,156,515 discloses a mechanical letter opener in which the cutter device is made up of two cutting members, namely a top member and a bottom member, which may be referred to as "cutter wheels" or as "cutters" and which are disposed in offset manner in the cutting plane so that their adjacent inclined edge faces can appropriately flank the envelope to be cut open.

Unfortunately, that device is not without drawbacks. Firstly, that arrangement of the cutters inevitably gives rise to the envelope being cut through completely and thus generates shreds of paper or "chaff" from the cut-off portion of the envelope. Secondly, depending on the mode of conveying used for moving the envelopes, if the diameter(s) of the drive rollers in contact with the envelope while it is being opened differ(s) from the diameter(s) of the cutters (as is frequent because of manufacturing tolerances), the linear speed at the surface of the envelope is not the same at the cutters as at the drive rollers, even though they are driven at an identical speed. And if, for example, the speed of movement of the top of the envelope (in contact with the drive rollers) is less than the speed of movement of the bottom of the envelope (in contact with the cutters), the envelope tends to move away from the conveyor surface so that the cutting might be incomplete, taking place in empty space in the vicinity of one end of the envelope, leaving an envelope that is cut half-open with a portion remaining closed.

OBJECT AND DESCRIPTION OF THE INVENTION

An object of the present invention is thus to mitigate those drawbacks with a cutter device for a mail-handling machine that mitigates the above-mentioned drawback by enabling cutting to take place over the entire length(s) of the envelopes in a direction that is exactly parallel to the conveyor surface. Another object of the invention is to enable the cutting to take place over a single face of the envelope so as not to generate chaff. Another object of the invention is to propose a cutter device that is not dependent on cutter manufacturing tolerance.

These objects are achieved by a cutter device for cutting envelopes open, which cutter device includes a rotary cutter suitable for cutting open an envelope, wherein said cutter device further includes a rotary bearing element that faces said rotary cutter and against which said envelope is in contact as it goes past said rotary cutter, an axis of rotation of the bearing element forming a predetermined angle of inclination $\alpha$ with a drive axis of said rotary cutter.

Thus, the inclination of the rotary bearing element makes it possible, by jogging the envelope against the conveyor path, to keep it in a constant position while it is moving, and thus to generate cutting that is regular.

Depending on the embodiment, said rotary bearing element may be a rolling bearing or a smooth bearing.

Preferably, said predetermined angle of inclination $\alpha$ lies in the range 1° to 5°.

Advantageously, said rotary bearing element is mounted on a support provided with a presser element that is offset laterally relative to a cutting axis P passing through said axis of rotation of said rotary bearing element and through said drive axis of said rotary cutter, and enabling said rotary bearing element to tilt about said cutting axis through said predetermined angle of inclination $\alpha$.

Depending on the embodiment, said presser element comprises a screw passing through said support and having a smooth pad mounted on its end, or comprises a through assembly made up of a screw acting on a ball via a spring.

Advantageously, said support is mounted to move along said cutting axis in opposition to a resilient return element, and said support is mounted on a threaded rod provided with a nut-and-locknut assembly bearing against a stationary portion of said device in such a manner as to maintain said rotary bearing element at a predetermined distance d from said rotary cutter.

The invention also provides a mail-handling machine including:

conveyor means for conveying an envelope in a direction of movement D; and a cutter device for cutting envelopes open as defined above.

BRIEF DESCRIPTION OF THE DRAWINGS

Other characteristics and advantages of the present invention appear more clearly from the following description given by way of non-limiting indication, and with reference to the accompanying drawings, in which.

DESCRIPTION OF A PREFERRED EMBODIMENT

Figure 1:
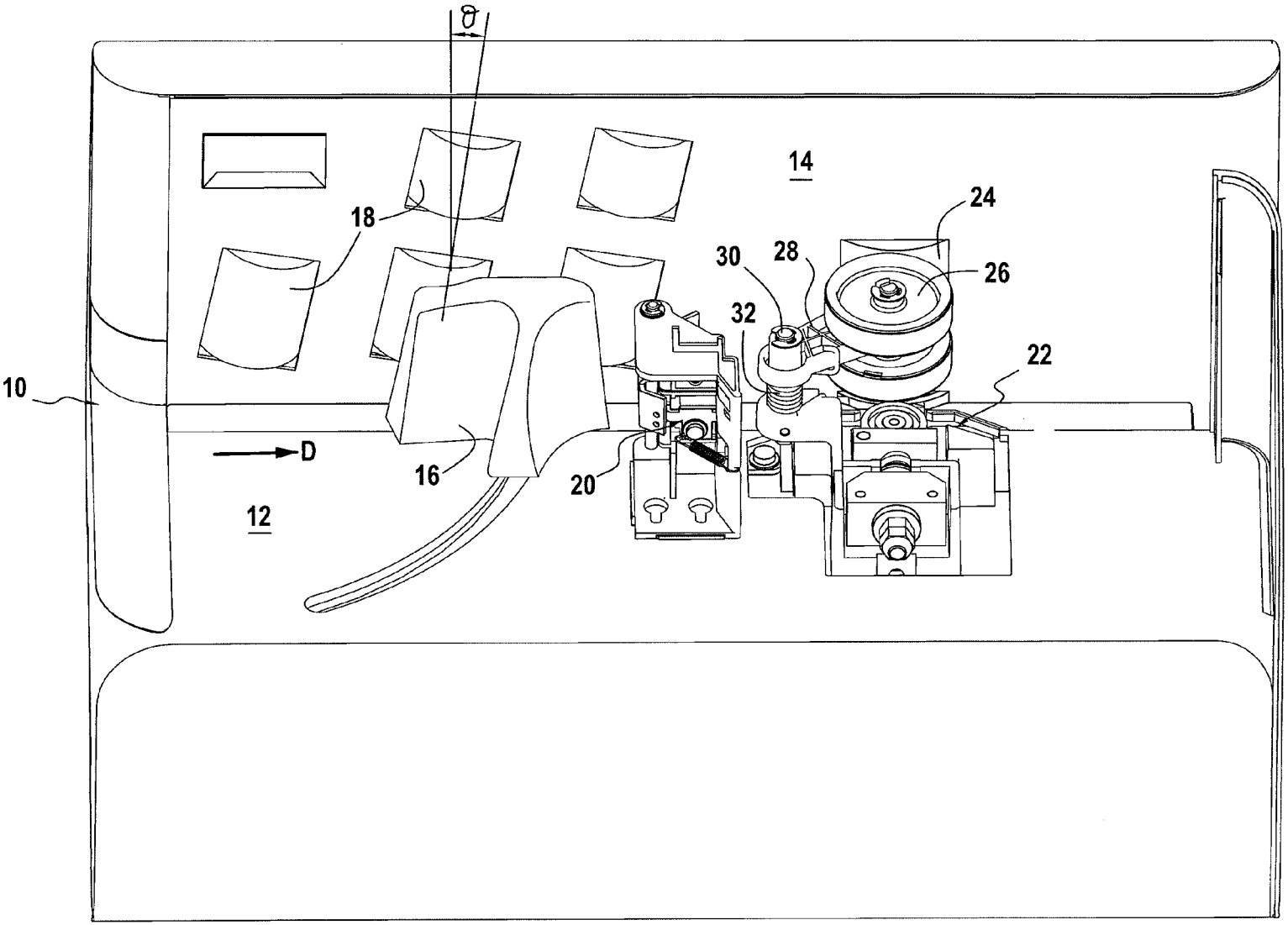
FIG. 1 is a perspective view of an envelope-opener machine including a cutter device of the invention.

FIG. 1 shows an example of an envelope-opener machine architecture 10 in which the envelopes to be opened are placed on edge in a stack, preferably formed by a homogeneous batch, resting on an envelope-receiving deck 12. These envelopes are jogged against a vertical conveyor wall 14 by a moving guide 16 pressed against said envelopes, e.g. by spring means (not shown) disposed under the envelope-receiving deck. First motor-driven conveyor rollers 18 stand proud through the vertical conveyor wall for the purpose of moving said envelopes along a conveyor path in a conveying direction D towards a selector device 20 for selecting said envelopes one-by-one, and then towards the cutter device 22 proper. These first conveyor rollers 18 are advantageously inclined towards the envelope-receiving deck at an angle $\theta$ lying in the range 5° to 15°.

Second motor-driven conveyor rollers 24 standing proud through the conveyor wall in register with the cutter device are provided for the purpose of moving the envelope along the conveyor path. While it is being cut, said envelope is held by opposite pressure-applying rollers 26 that are mounted to be free to rotate about their shaft(s) and that are mounted on an arm 28 that is mounted to pivot about a shaft 30 provided with a return spring 32. Unlike the first conveyor rollers 18, and so as to avoid any risk of creasing the enveloped being conveyed, said second rollers 26 are not inclined towards the conveyor path and thus towards the envelope-receiving deck, but rather they are exactly perpendicular to said path.

Figure 2:
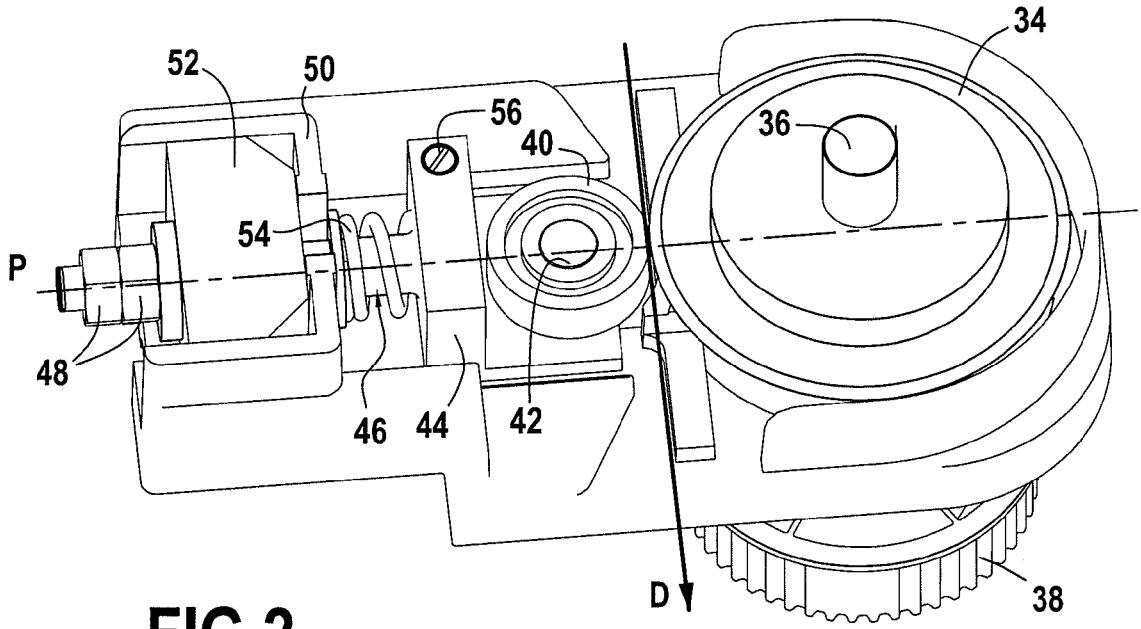
FIG. 2 is a perspective view of the cutter device of the invention.
Figure 3:
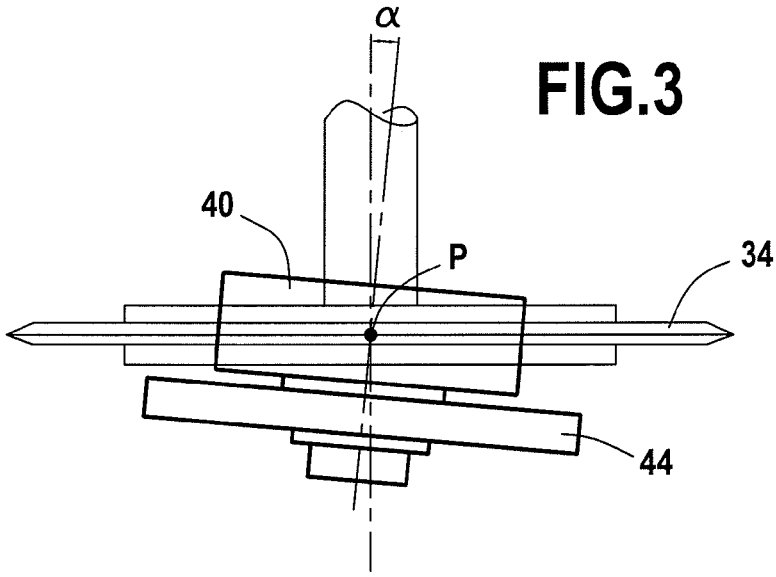
FIG. 3 is a detail view of the cutter device showing the inclination between the rotary envelope-bearing element and the rotary cutter.

The cutter device 24 shown in perspective in FIG. 2 has a rotary cutting blade or "cutter" 34, driven in rotation about a drive axis that is embodied by a drive shaft 36 and that is perpendicular to the conveying direction D by a conventional motor-driven cog-and-belt assembly, only the cog 38 of the assembly being shown. It should be noted that this assembly is preferably motor-driven in common with the first and second conveyor rollers via a suitable drive mechanism. Facing the rotary cutter 34 and disposed at a predetermined distance d from its periphery of approximately in the range 30 micrometers (μm) to 50 μm (corresponding substantially to the thickness of one face of the envelope), there is disposed a rotary bearing element such as a rolling bearing 40 mounted to be free to rotate about an axis of rotation that is embodied by a shaft 42 secured to a support 44 and that is inclined towards the envelope-receiving deck at an angle α lying in the range 1° to 5° relative to a perpendicular to the conveying direction D (any greater inclination would give rise to excessive braking of the moving envelope that would crease it, so that the plane of this rolling bearing and the plane of the cutter also form, between them, the same angle α lying in the range 1° to 5° (see the detail of FIG. 3). The predetermined distance is chosen such that only one portion of the envelope is cut rather than both portions being cut with the risk of generating chaff, and the angle of inclination is chosen in such a manner as to keep the envelope constantly on its edge, and as to prevent the envelope from shifting (and thus from lifting) as it advances through the cutter device. In addition, this inclination makes it possible to ignore the manufacturing tolerances of the cutter and of the rotary bearing element.

The support 44 is held in a predefined position making it possible to define the predetermined distance d by means of a threaded rod 46 provided with a nut-and-locknut assembly 48 that bears against a stationary portion 50 of the device directly, or through an intermediate guide part 52 as shown. A resilient return element such as a compression spring 54 makes it possible to return to said predefined position when the rolling bearing has been moved, e.g. when a jam occurs. The support 44 is mounted to slide linearly in the device along a cutting axis P that passes through the drive axis of the rotary cutter and through the axis of rotation of the rolling bearing, and that is perpendicular to the direction D of movement of the envelope to be cut.

The jam is detected by means of a detection cell (not shown) placed in the vicinity of the cutter 34, and making it possible to detect passage of envelopes being opened. This cell is preferably of the optoelectronic type. However, a contact sensor may also be used. In normal operation, an envelope going past the cutter causes the cell to be masked, typically for a time of less than 2 seconds, and then to be unmasked once the envelope is totally open, and then to be masked again by the following envelope. Thus, if the cell remains masked, for example, for more than 3 seconds, this means that an envelope is blocked at the cutter. The motors driving the cutter and the conveyor rollers are then stopped and a jam is indicated to the user. Similarly, if the cell remains unmasked for more than 3 seconds and if the magazine is not empty (information given by a sensor disposed in the magazine indicating that envelopes remain to be opened), that indicates that the rollers 18 cannot manage to select the following envelope. In such a situation, the motors driving the cutter and the rollers are also stopped, and a selection problem is indicated to the user.

Figure 4A:
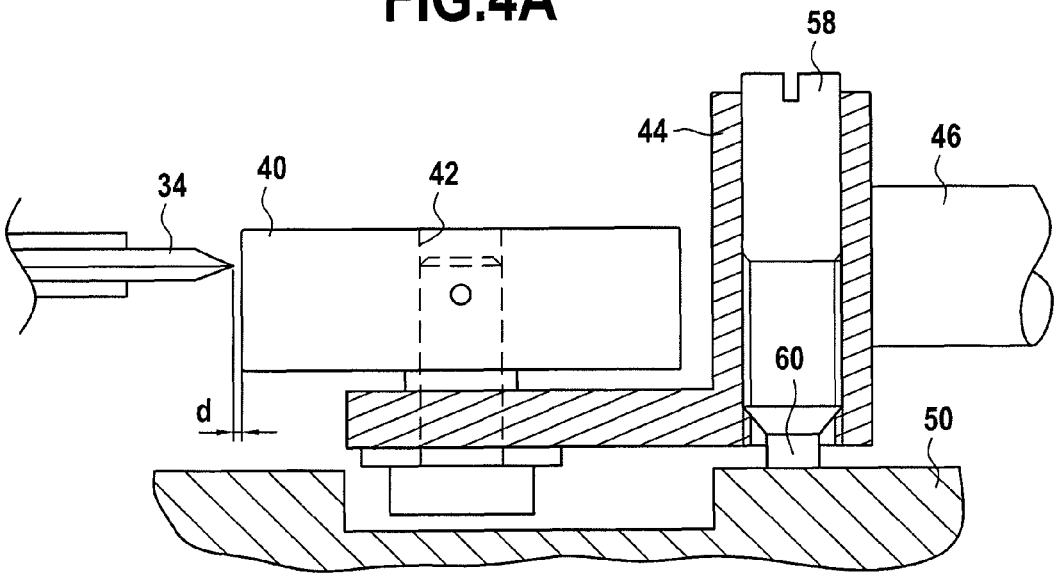
FIGS. 4A and 4B are longitudinal section views of two embodiments of means for inclining the rotary bearing element of the invention.

The inclination of the axis of the rolling bearing 40 relative to axis of the rotary cutter 34, and thus the corresponding inclination of the support 44 is obtained by a presser element 56 offset laterally relative to the cutting axis P and that makes it possible to tilt the support through the desired angle without limiting its movement along the cutting axis P. More particularly, as shown in the embodiment of FIG. 4A, said presser element comprises a screw, advantageously a headless screw 58, passing through the support 44 and having its end fastened to a smooth pad 60, preferably made of poly-tetrafluoroethylene (PTFE) in order to make it easier for it to slide over the stationary portion 50 of the device. Another embodiment, shown in FIG. 4B, shows a presser element formed of an assembly comprising a ball, a spring, and a screw, the screw 62 acting on the ball 64 via the spring 66, free movement along the cutting axis P being made possible, in this example, merely by the ball rolling.

Figure 4B:
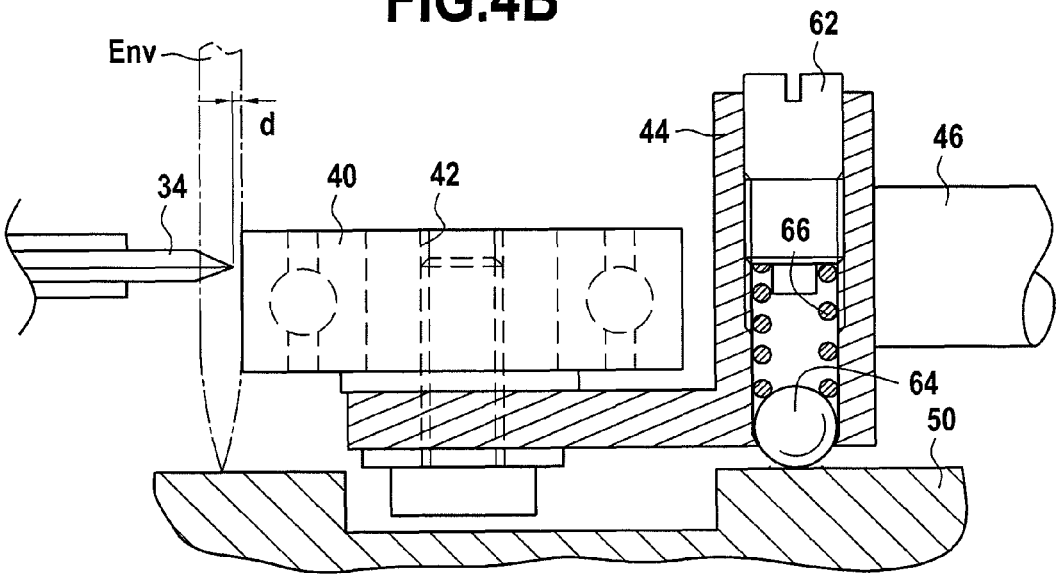

It should be noted that, although the rolling bearing shown in FIG. 4B is of the ball-bearing type, naturally some other type of rolling bearing, e.g. a roller-bearing, is equally possible, indeed as is a mere smooth bearing, as shown in FIG. 4A.

The device operates as follows. Firstly, a stack of envelopes is placed on the envelope-receiving deck 12 and is jogged against the vertical conveyor wall 14 by the guide 16. The machine is then switched on, thereby causing the first conveyor rollers 18 to rotate so that they extract the bottom envelope from the stack, and only said bottom envelope, by means of the combined action of the selector device 20. Once the envelope has been extracted, the second conveyor rollers 24 and the pressure-applying rollers 26 take over handling of the envelope and bring it through the cutter device 22, where the rotary cutter 34 cuts the envelope slightly above its edge face in contact with the conveyor path. The inclination of the rotary bearing element towards the conveyor path, and thus towards the envelope-receiving deck, enables the envelope to remain constantly in contact with said path, thereby guaranteeing that the envelope is cut in exactly parallel manner over the entire length of the envelope.

Thus, with the cutter device of the invention, the envelope can be opened over a single face so as not to generate any chaff because the distance between the cutter and the rolling bearing is constantly maintained at the chosen distance d. If this distance is too large, the envelope is not opened, and, conversely, if it is too small, the envelope is cut over both of its faces and thus generates undesired chaff.

What is claimed is:

1. A cutter device for cutting envelopes open, which cutter device includes a rotary cutter suitable for cutting open an envelope, wherein said cutter device further includes a rotary bearing element that faces said rotary cutter and against which said envelope is in contact as it goes past said rotary cutter, an axis of rotation of the bearing element forming a predetermined angle of inclination α with a drive axis of said rotary cutter, wherein said rotary bearing element is mounted on a support provided with a presser element that is offset laterally relative to a cutting axis P passing through said axis of rotation of said rotary bearing element and through said drive axis of said rotary cutter, and enabling said rotary bearing element to tilt about said cutting axis through said predetermined angle of inclination α.

2. A device according to claim 1, wherein said rotary bearing element is a smooth bearing.

3. A device according to claim 1, wherein said rotary bearing element is a rolling bearing.

4. A device according to claim 2, wherein said predetermined angle of inclination $\alpha$ lies in the range 1° to 5°.

5. A device according to claim 1, wherein said presser element comprises a screw passing through said support and having a smooth pad mounted on its end.

6. A device according to claim 1, wherein said presser element comprises a through assembly made up of a screw acting on a ball via a spring.

7. A device according to claim 1, wherein said support is mounted to move along said cutting axis in opposition to a resilient return element.

8. A device according to claim 7, wherein said support is mounted on a threaded rod provided with a nut-and-locknut assembly bearing against a stationary portion of said device in such a manner as to maintain said rotary bearing element at a predetermined distance d from said rotary cutter.

9. A mail-handling machine including:

conveyor means for conveying an envelope in a direction of movement D; and a cutter device for cutting envelopes open according to claim 1.

* * * * *